US005861718A

United States Patent [19]

Pruett

[11] Patent Number: 5,861,718

[45] Date of Patent: Jan. 19, 1999

[54] ARC LAMP IGNITER APPARATUS AND METHOD

[75] Inventor: Henry Frazier Pruett, Sandy, Oreg.

[73] Assignee: In Focus Systems, Inc., Wilsonville, Oreg.

[21] Appl. No.: 919,629

[22] Filed: Aug. 28, 1997

[51] Int. Cl.[6] ..... H05B 41/18

[52] U.S. Cl. ..... 315/176; 315/220; 315/209 CD; 315/290

[58] Field of Search ..... 315/176, 219, 315/220, 222, 209 CD, 239, 277, 278, 290

[56] References Cited

U.S. PATENT DOCUMENTS 4,331,905 5/1982 Owen ..... 315/220 X 4,958,109 9/1990 Naum ..... 315/290 X 5,426,346 6/1995 Allison ..... 315/209 CD

*Primary Examiner*—David Mis

*Attorney, Agent, or Firm*—Stoel Rives LLP

[57] ABSTRACT

An arc lamp igniter circuit (10) employs a resonant inverter circuit (16) to convert low-voltage DC to a relatively high-voltage, 80 kilohertz sinusoidal AC voltage that is rectified and voltage-doubled (42, 44, 46) to about 2,500 volts DC for repetitively charging an igniter capacitor (50) until it discharges through a spark gap (58) and a primary winding (54) of a compact, low-mass igniter transformer (52). A secondary winding (56) of the igniter transformer provides repetitive 20 kilovolt pulses, which are sufficient to ionize a metal halide arc lamp (14), causing it to ignite and produce intense illumination.

19 Claims, 1 Drawing Sheet

ARC LAMP IGNITER APPARATUS AND METHOD

RELATED APPLICATIONS

Not Applicable

FEDERALLY SPONSORED RESEARCH OR DEVELOPMENT

Not Applicable

TECHNICAL FIELD

This invention relates to bright illumination sources and more particularly to a compact, light weight (low mass) arc lamp igniter circuit for use in "ultra-portable" image-projectors.

BACKGROUND OF THE INVENTION

There are previously known apparatuses and methods for igniting arc lamps used in various applications requiring a bright light source, such as computer-generated image and slide projectors. In particular, prior igniter circuits discharge a capacitor through a spark gap that is electrically connected in series with the primary winding of a step-up transformer to produce a high-voltage pulse suitable for igniting a metal halide arc lamp.

Developing a sufficiently high voltage across the capacitor typically employs at least one of generating direct current ("DC") pulses, rectifying an alternating current ("AC") square wave, or rectifying a flyback voltage generated by an inductor. All such techniques employ relatively large and heavy magnetic components that are unduly inefficient because of parasitic winding capacitance and poor coupling between windings.

Image projectors are generally referred to as being ultra-portable if they are sufficiently small and lightweight to be carried by one. However, the above-described arc lamp igniter circuits typically have a mass of at least about 140 grams, making them one of the heaviest subassemblies employed in portable image projectors.

What is needed, therefore, is an efficient, low-mass, and compact arc lamp igniter circuit for use in "ultra-portable" projectors.

SUMMARY OF THE INVENTION

An object of this invention is, therefore, to provide an apparatus and a method for igniting arc lamps.

Another object of this invention is to provide a low mass, compact arc lamp igniter circuit.

A further object of this invention is to provide an arc lamp igniter circuit suitable for use in ultra-portable projectors.

A preferred arc lamp igniter circuit of this invention employs a resonant inverter to convert low-voltage DC to a high-voltage, 80 kilohertz sinusoidal AC voltage that is rectified and voltage-doubled to about 2,500 volts DC for charging a capacitor until it discharges through a spark gap and a primary winding of a compact, low-mass igniter transformer. A secondary winding of the igniter transformer provides a greater than about 20 kilovolt pulse, which is sufficient to initially ionize a metal halide arc lamp, causing it to conduct and produce intense illumination.

An advantage of this invention is that the resonant inverter uses the parasitic capacitance of an inverter transformer to efficiently generate the sinusoidal AC voltage.

Another advantage of this invention is that the igniter circuit is very compact and weighs less than about 50 grams, making it particularly suitable for use in ultra-portable image projectors.

Additional objects and advantages of this invention will be apparent from the following detailed description of a preferred embodiment thereof that proceeds with reference to the accompanying drawing.

DETAILED DESCRIPTION OF A PREFERRED EMBODIMENT

Figure 1:
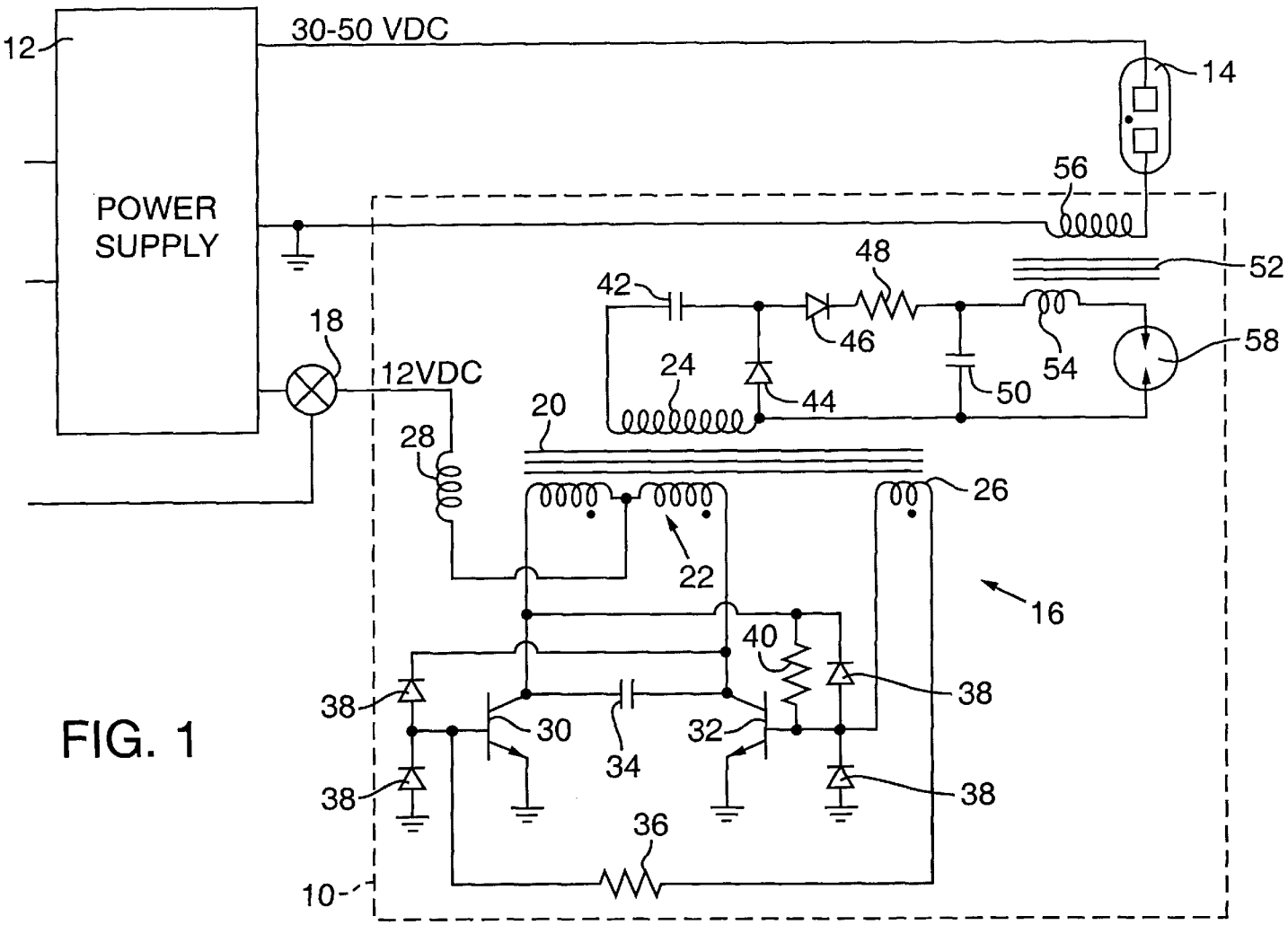
FIG. 1 is an electrical schematic diagram showing a preferred embodiment of an arc lamp igniter circuit of this invention.

FIG. 1 shows a preferred arc lamp igniter circuit 10 of this invention. A high-efficiency power supply 12 provides a DC ballast voltage source for an arc lamp 14 and about a 12 volt DC voltage source for an inverter circuit 16 (hereafter "inverter 16"). Arc lamp 14 is preferably a 30 to 50 volt, 270 watt, metal-halide arc lamp, although arc lamps dissipating less than about 300 watts are suitable. A conventional electronic switch 18 controllably applies the 12 volt DC voltage source to inverter 16 for a brief period, preferably less than two seconds, when power supply 12 is energized, thereby enabling igniter circuit 10 to initially ionize arc lamp 14, causing it to arc and continuously draw current from the DC ballast voltage source to produce intense illumination. Alternatively, switch 18 may be a manually operated mechanical switch.

Inverter 16 is modified from a compact inverter employed in laptop computers to power AC fluorescent backlighting lamps in liquid crystal display panels. Such invertors generate a moderately high-voltage AC sine wave that is electrically connected to the fluorescent lamp. Inverter 16 includes an inverter transformer 20 having respective primary, secondary, and feedback windings 22, 24, and 26 with typical parasitic capacitances and mutual couplings. Inverter transformer 20 is preferably a model CTX 210403 manufactured by Coiltronics, Inc., Boca Raton, Fla. In this invention, the parasitic capacitances of windings 22 and 24 are exploited by operating inverter transformer 20 in a lightly loaded, parallel resonant mode to boost the AC voltage generated across secondary winding 24.

In particular, inverter 16 operates as follows. The center tap on inverter transformer 20 primary winding 22 receives 12 volt DC from an electromagnetic interference suppressing inductor 28, preferably about 100 microhenrys, and conducts the 12 volt DC through the oppositely phased ends of primary winding 22 to the collectors of cross-coupled inverter transistors 30 and 32, preferably type No. ZTX651 manufactured by Zetex, Oldham, United Kingdom. A capacitor 34, preferably about 33 nanofarads, parallel resonates primary winding 22 along with its parasitic capacitance at about 85 kilohertz, which determines the operating frequency of inverter 16. Feedback winding 26 provides positive feedback to the bases of inverter transistors 30 and 32 to reinforce and sustain inverter 16 oscillation. Feedback current is limited by a resistor 36, preferably 619 ohms, and feedback voltage is clamped to safe levels by diodes 38, preferably type No. BAV99, manufactured by Philips, Sunnyvale, Calif., which diodes are manufactured two to a package to save space. Of course, electrically equivalent singly-packaged diodes, such as type No. 1N4148, may be substituted. An unbalancing resistor 40, preferably about 10,000 ohms, ensures self-starting of inverter 16.

The voltage generated across secondary winding 24 of inverter transformer 20 is stored across a voltage-doubler capacitor 42, preferably 22 picofarads. Skilled workers will understand that voltage-doubler capacitor 42 may be alternatively implemented by combining the parasitic capacitance of secondary winding 24 with properly sized associated etched-circuit board conductors.

The AC voltage developed by secondary winding 24 and stored by voltage-doubler capacitor 42 is rectified and doubled to about 2,500 volts DC by diodes 44 and 46, preferably 3,000 volt breakdown, 100 nanosecond recovery time, switching diodes type No. HX30P manufactured by Electronic Devices, Inc., Yonkers, N.Y. These high-voltage diodes are preferred because of their fast recovery time and very compact package style. Alternatively, the voltage-doubler may be replaced by a non-doubling rectifier or by a voltage-multiplier circuit.

A charging resistor 48, preferably 1 megohm, lightly loads secondary winding 24 and exponentially charges an igniter capacitor 50, preferably 10 nanofarad, 3,000 volt breakdown, toward the 2,500 volts DC stored by voltage-doubler capacitor 42.

An igniter transformer 52 has respective primary and secondary windings 54 and 56, preferably wound on a 5.1 centimeter long, 10 millimeter diameter, nickel zinc ferrite core formed from Philips 4B1 material. Primary winding 54 preferably includes three turns of 16 gauge, double TEFLON insulated wire, and secondary winding 56 preferably includes a single layer of 35 turns of close wound 18 gauge magnet wire. The resulting igniter transformer 52 is compact and has a low mass.

Primary winding 54 is connected in series with a spark gap 58, preferably type No. A71HX25, manufactured by Seimens, Iselen, N.J. The series combination of primary winding 54 and spark gap 58 is connected across igniter capacitor 50 such that when the voltage across igniter capacitor 50 charges up to the breakdown voltage of spark gap 58, igniter capacitor 50 discharges through the series combination of spark gap 58 and primary winding 54 of igniter transformer 52, causing about a 20 kilovolt pulse to be generated across secondary winding 56, which is connected to arc lamp 14. The 20 kilovolt pulse is sufficient to ionize arc lamp 14, causing it to ignite and continuously conduct current from power supply 12 to produce intense illumination.

Charging resistor 48, igniter capacitor 50, and spark gap 58 form a relaxation oscillator that repetitively discharges igniter capacitor 50 through primary winding 54 during the less than two seconds that switch 18 is typically closed. The corresponding repetitions of 20 kilovolt pulses ensure that arc lamp 14 is sufficiently ionized to ignite.

The above-described igniter circuit 10 is compact, has a mass less than about 50 grams, and is, therefore, suitable for use in ultra-portable image projectors.

Skilled workers will recognize that portions of this invention may be implemented differently from the implementation described above for a preferred embodiment. For example, various component type substitutions, value changes, voltage range changes, frequency changes, and circuit topology variations may be employed to suit various arc lamp applications.

It will be obvious to those having skill in the art that many changes may be made to the details of the above-described embodiment of this invention without departing from the underlying principles thereof. Accordingly, it will be appreciated that this invention is also applicable to arc lamp igniting applications other than those found in ultra-portable image projectors. The scope of the present invention should, therefore, be determined only by the following claims.

I claim:

1. An apparatus for igniting an arc lamp, comprising:

an inverter changing a low direct current ("DC") voltage to a substantially sinusoidal alternating current voltage, the inverter including an inverter transformer having a primary winding with a parasitic capacitance and a secondary winding;

a resonating capacitor electrically connected in parallel with the primary winding and the parasitic capacitance causing the inverter to operate at a resonant frequency of the inverter transformer;

a voltage-multiplying rectifier circuit electrically connected to the secondary winding of the inverter transformer to develop a high DC voltage;

an igniter capacitor lightly coupled by a charging resistor to the voltage-multiplying rectifier circuit to develop a high DC voltage charge across the igniter capacitor;

an igniter transformer having a primary winding that is connected to the igniter capacitor and a secondary winding that is connected to the arc lamp; and a spark gap electrically connected to the igniter capacitor and the primary winding of the igniter transformer such that the high DC voltage charge across the igniter capacitor discharges through the spark gap and the primary winding of the igniter transformer to couple across the secondary winding of the igniter transformer a high-voltage pulse that ionizes the arc lamp.

2. The apparatus of claim 1 in which the low DC voltage is about 12 volts.

3. The apparatus of claim 1 in which the resonating capacitor has a capacitance of about 33 nanofarads.

4. The apparatus of claim 1 in which the resonant frequency of the inverter transformer is about 85 kilohertz.

5. The apparatus of claim 1 in which the voltage-multiplying rectifier circuit is a voltage-doubler and the high DC voltage is about 2,500 volts.

6. The apparatus of claim 1 in which the charging resistor has a resistance of about 1 megohm.

7. The apparatus of claim 1 in which the igniter capacitor has a capacitance of about 10 nanofarads.

8. The apparatus of claim 1 in which the spark gap has a breakdown voltage of less than about 2,500 volts.

9. The apparatus of claim 1 in which the high-voltage pulse has an amplitude of at least about 20,000 volts.

10. The apparatus of claim 1 in which the igniter transformer is a step-up transformer having about a 3:35 turns ratio.

11. The apparatus of claim 10 in which the igniter transformer has a ferrite rod core having about a 5 centimeter length and about a 10 millimeter diameter.

12. The apparatus of claim 1 in which the arc lamp is a metal halide arc lamp having a power dissipation of less than about 300 watts.

13. The apparatus of claim 1 further including a switch that causes repetitive operation of the apparatus during a period of less than about 2 seconds to ensure a sufficient ionization of the arc lamp for its ignition.

14. The apparatus of claim 1 in which a mass of the apparatus, not including a mass of the arc lamp, is less than about 50 grams.

15. A method of igniting an arc lamp, comprising:

providing an igniter transformer having a primary winding and a secondary winding;

connecting the arc lamp to the secondary winding of the igniter transformer;

providing an inverter that changes a low direct current ("DC") voltage to a substantially sinusoidal alternating current voltage, the inverter including an inverter transformer having a primary winding and a secondary winding;

operating the inverter at a resonant frequency of the primary winding of the inverter transformer;

connecting a voltage-multiplying rectifier circuit to the secondary winding of the inverter transformer to develop a high DC voltage;

charging an igniter capacitor from the high DC voltage; and discharging the igniter capacitor through a spark gap and the primary winding of the igniter transformer to couple a high-voltage ignition pulse into the arc lamp.

16. The method of claim 15 in which the primary winding of the inverter transformer has a parasitic capacitance and the operating step includes connecting a resonating capacitor in parallel with the parasitic capacitance.

17. The method of claim 15 in which the voltage-multiplying rectifier circuit includes a voltage-doubler.

18. The method of claim 15 in which the charging step includes connecting a high-resistance charging resistor between the high DC voltage and the igniter capacitor.

19. The method of claim 15 further including repeating the charging and discharging steps during a period of less than about 2 seconds to ensure a sufficient ionization of the arc lamp for its ignition.

* * * * *